US007621516B2

(12) United States Patent
Feuiltault et al.

(10) Patent No.: US 7,621,516 B2
(45) Date of Patent: Nov. 24, 2009

(54) METHOD AND APPARATUS FOR FEEDING FLAT PRINTED PRODUCTS

(75) Inventors: Dominique Feuiltault, Mont St. Hilaire (CA); Marc Lajoie, St. Hubert (CA)

(73) Assignee: Systemes Feuiltault Solutions Inc., Mont St. Hilaire (CA)

( * ) Notice: Subject to any disclaimer, the term of this patent is extended or adjusted under 35 U.S.C. 154(b) by 359 days.

(21) Appl. No.: 10/599,492

(22) PCT Filed: Mar. 18, 2005

(86) PCT No.: PCT/IB2005/001705

§ 371 (c)(1),
(2), (4) Date: Sep. 29, 2006

(87) PCT Pub. No.: WO2005/094164

PCT Pub. Date: Oct. 13, 2005

(65) Prior Publication Data

US 2008/0258377 A1 Oct. 23, 2008

(30) Foreign Application Priority Data

Apr. 2, 2004 (CA) ..... 2462836
Jun. 3, 2004 (CA) ..... 2468357

(51) Int. Cl.
*B65H 39/02* (2006.01)

(52) U.S. Cl. ..... 270/52.16; 270/52.14; 270/52.19; 270/52.2; 270/52.22; 270/58.29

(58) Field of Classification Search ..... 270/52.14, 270/52.16, 52.19, 52.2, 52.22, 58.29; 271/100, 271/106, 132, 149, 151
See application file for complete search history.

(56) References Cited

U.S. PATENT DOCUMENTS

| | | | | |
|---|---|---|---|---|
| 5,088,711 | A * | 2/1992 | Newsome | 270/52.14 |
| 5,149,083 | A | 9/1992 | Merkli et al. | |
| 5,556,087 | A * | 9/1996 | Gosslinghoff | 270/58.18 |
| 6,022,014 | A * | 2/2000 | Rathert et al. | 271/11 |
| 6,076,824 | A | 6/2000 | Oppliger et al. | |
| 6,547,231 | B1 * | 4/2003 | Chick | 270/58.29 |
| 2003/0218297 | A1 | 11/2003 | Honegger | |
| 2005/0073083 | A1 * | 4/2005 | Burk et al. | 270/52.18 |

* cited by examiner

*Primary Examiner*—Gene Crawford
*Assistant Examiner*—Leslie A Nicholson, III
(74) *Attorney, Agent, or Firm*—Gudrun E. Huckett

(57) ABSTRACT

The invention refers to a method and an apparatus for gathering flat printed products by selecting a single printed product from each of a multitude of collections of identical printed products and conveying the selected printed products towards a collecting conveyor (10), which runs along a generally straight line in a first direction (11).

To improve the transfer of the flat printed products to the downstream machinery, it is suggested to

- advance the printed products in a second direction (15) in a continuous flow of printed products with a feeder (1) with feeding elements upstream of the collecting conveyor (10),
- grip a leading portion (20) of a printed product at the discharge end of said feeder (1) by separating grippers (60) of a transferring conveyor (40) which is also arranged up-stream of the collecting conveyor (10) and
- transfer the gripped printed product with the transferring conveyor (40) substantially along a path, which takes its course generally along the first direction (11) of the collecting conveyor (10).

27 Claims, 5 Drawing Sheets

METHOD AND APPARATUS FOR FEEDING FLAT PRINTED PRODUCTS

1. FIELD OF THE INVENTION

The present invention relates to a method for gathering flat printed products, especially signatures, by selecting a single printed product from each of a multitude of collections of identical printed products and conveying the selected printed products towards a collecting conveyor, where the selected printed products are piled up, which runs along a generally straight line in a first direction.

The present invention also relates to an apparatus for gathering flat printed products, especially signatures, comprising a plurality of feeders arranged in a sequence each for a collection of identical printed products with a selecting device for selecting single flat printed products and a collecting conveyor, where the selected printed products are piled up, which runs along a generally straight line in a first direction.

2. BRIEF DESCRIPTION OF THE PRIOR ART

It its known from prior art to use such methods and apparatuses for handling flat products such as printed products, also called "signatures", to feed downstream machinery. Upstream of bindery machinery, there are usually used rotary drum gathering systems to separate, pull and pick-up signatures from each bottom of a horizontal stack in a hopper and transfer the separated signatures to build piles collated on either a saddle or pocket collecting conveyor, the piles being fed to the downstream stitching, sewing or gluing operation to produce books or magazines. Alternatively, gripping systems have also been used with the assistance of separating tooling such as rotary cam separators and vacuum plates cooperating to separate the lowermost signature being pulled down from the rest of the pile being supported by the separating device.

In the document EP 1 234 790 B1 it is disclosed to advance printed products in a shingled formation by a belt conveyor towards a feed conveyor station, where the printed products are fed into a second conveyor which initially lifts the printed products upwards, then downwards again and finally disposes them on a collecting conveyor. To achieve a satisfactory function of this apparatus, the shingled formation of printed products in the belt conveyor must be generated with a very high precision, which requires substantial technical efforts. Also the precise disposal of the flat printed products by the second conveyor is difficult to achieve, which limits the maximum throughput of the apparatus.

Feeding of the hopper was traditionally accomplished manually by an attendant taking a pile of signatures and bending the pile back and forth a few times to ensure proper separation of the signatures. It is also well known in the field to replace the attendant by a feeder, also called hopper loader, carrying-out separation reliability with increased throughput and lower operating costs, to deliver the signatures to the horizontal hopper of a gatherer, separated in forwardly inclined shingled continuous stream.

The document DE 196 16 047 B4 discloses an apparatus where the printed products are fed into hoppers, from where each of the lowermost printed products from the piles in the hoppers is distributed towards a collecting conveyor, which is arranged underneath the hoppers. As the printed products are distributed by belt conveyors, the maximum throughput of the apparatus is limited, if a safe intake of the individual printed products into the belt conveyor shall be safeguarded.

However, feeding the signatures to form a vertical stack in a hopper still requires a complex system to meet stack build-up parameters and select and grip one single signature at a time to perform the transfer to a collecting conveyor thereafter. Many such systems have been developed so far with the object to perform these tasks with acceptable yield and throughput, but still with a high level of complexity and proportional cost. For example, the signatures have been advanced with start- and stopcycles of a hopper loader towards a hopper, which caused substantial variations in the throughput performance of the hopper. Due to the varying height of the pile in the hopper, misselections of printed products occurred.

A few examples of direct transfer apparatuses have also been thought in prior patents, but still remain complex, mainly because signatures are always picked-up by grippers traveling in the same stream direction of the signatures fed by a feeder while signatures are to be transferred to a collecting conveyor running in an orthogonal direction. Therefore, the feeding systems known from prior art remain complex, costly, subject to miss-feeds and only perform a limited maximum feed speed.

3. SUBJECT OF THE INVENTION

Therefore, it is the subject of this invention to deliver flat printed products by a feeder in a continuous stream and to feed the flat printed products into a collecting conveyor, which transfers the accumulated piles to downstream machinery. It is specifically requested to provide an ultra-high speed, simple and reliable method and apparatus for feeding signatures of a bindery line for the manufacture of books or the like.

The above review of the prior art clearly shows that the solutions of the prior art contemplating the feeding of collecting conveyors upstream of bindery machines, from an incoming stream of flat printed products, still present several limitations and drawbacks. Therefore, there is a need for an improved flat printed products feeding and separating method and apparatus obviating such limitations and drawbacks of the prior art devices and methods.

4. SUMMARY OF THE INVENTION

The present invention overcomes the limitations and drawbacks of the above mentioned prior art for known methods by the following steps:

- advancing the printed products in a second direction in a continuous flow of printed products with a feeder with feeding elements upstream of the collecting conveyor,
- gripping a leading portion of a printed product at the discharge end of said feeder by separating grippers of a transferring conveyor which is also arranged upstream of the collecting conveyor,
- transferring the gripped printed product with the transferring conveyor substantially along a path, which takes its course generally along the first direction of the collecting conveyor.

For an apparatus the problem is solved by the elements, that the feeders advance the printed products by feeding elements in a second direction in a continuous flow of printed products, a transferring conveyor comprises at least one separating gripper, which is capable of gripping a leading portion of a printed product at the discharge end of a feeder, and the transferring conveyor transfers the printed flat products substantially along a path, which takes its course generally along the first direction of the collecting conveyor.

By using the invention, it is possible to transfer flat printed products with an ultra-high speed into a collecting conveyor.

Though, this result can be achieved with a simple, cost-efficient and reliable mechanism which comprises only few movable elements. Only few space is required for the apparatus, especially for the transferring conveyor, and the method and apparatus is more fail-safe and require a less precise orientation of feeded printed products than the systems known from prior art.

This result is achieved by gripping the leading article one by one, preferably by its backbone, using separating grippers traveling along a linear path, generally orthogonal to the article stream orientation, but substantially in parallel to the straight line of travelling of the collecting conveyor, which runs along a generally straight line in the first direction. This handling principle avoids unnecessary turns and bends of the printed articles during their transfer from the feeders to the collecting conveyor. At the discharge end of the feeders the printed products are already oriented perfectly as required for sorting them into the pockets of the collecting conveyor. They only need a short push sidewards, and this push is achieved by gripping them with the separating grippers and dropping them into the collecting conveyor shortly afterwards.

As the separating grippers are moved along the entire length of the printed product, there is a comparably long time window open for gripping a printed product and pulling it away from the feeder. Therefore, the single printed products must not be oriented as precisely as it is required for the machines known from prior art, because a slightly uneven flow or orientation can be neutralized by the advanced arrangement according to this invention. As the time window for gripping a printed product with a separating gripper is longer with an apparatus designed according to this invention working with an identical throughput as the prior art machines, the apparatus is able to work faster as the prior art machines, when the time window is identical.

The machinery required for this short transfer movement is substantially less complex and costly, but much faster and reliable in its function. By adapting and adjusting the measurements and distances of the feeders, separating grippers and the pockets in the collecting conveyor and their respective working speeds advantageously relative to each other, the best throughput results can be achieved. The closing and opening cycles of the separating grippers also need to be adapted towards the respective applications. The gripping movement of the separating grippers may be mechanically effected by a lever whose action is triggered and controlled by a cam, or such movement may be performed by electronic sensors and electric drives and/or software-controlled.

The feeders are using feeding elements like belt conveyors to advance the printed products towards the discharge end of the feeder. For using the invention, it is not compulsory any more to feed the printed products first into a hopper as a feeding element to be able to separate the lowermost product and to transfer it into the collecting feeder thereafter. The invention can also be used by gripping the printed products directly from a shingled formation of printed products at the discharge end of the feeder. However, it is also still possible to use hoppers together with the invention, for example to leverage an uneven product flow.

There is further provided a further embodiment of the method for feeding flat printed products to a collecting conveyor, wherein said flat printed products, being folded or not, may comprise a leading portion with a backbone.

In a still further embodiment the method comprises an additional step comprising separating at least in part said leading portion from the next upstream article by the sucking force of at least one vacuum element prior to the grasping of said portion.

There is still provided a further embodiment of the method wherein separating at least in part said leading portion from the next upstream article by the sucking force of at least one vacuum element comprises pulling and holding down at least a corner of said leading portion by vacuum and further separating said leading portion by transversally running a separating device above said leading portion, from said corner to the opposite edge of the article, in order to lift upstream printed products to enable the grasping of said portion.

There is further provided a system for the feeding of flat printed products to a collecting conveyor which runs in a first direction, comprising a feeder running in a second direction, and at least one transferring conveyor with separating grippers travelling along a path generally oriented transversally to said second direction and generally along the first direction of the collecting conveyor, wherein said separating grippers can grip a leading portion of a printed product and transfer it onto said collecting conveyor.

In a further embodiment of the system, the gripper device further comprises a separating wedge portion comprising a separating edge facing towards the gripper's travelling direction.

In a further embodiment of the system, said first conveyor further comprises an articulated vacuum pick-up arm, whereby said leading portion of the most forward printed product is picked-up by said vacuum element and bent away from the neighbouring upstream printed product to separate at least in part the leading portion of said printed product from the next upstream printed product.

In an advantageous embodiment of this invention, the transfer path of the transferring conveyor is crosswisely arranged towards said second direction of the feeder and in a principal plane of the printed product to be gripped at the discharge end of said feeder. The spatial orientation of the separated printed product at the discharge end of the feeder or at the feed conveyor station respectively generally defines the principal plane of the printed product. Minor changes of the spatial orientation by slight inclinations along the feeding path of the feeder or bending of the printed products for separation purposes do not change the principal plane to a relevant extent. To move the printed product only to as much as it is technically required for the transfer from the feeder to the collecting conveyor, the transferring conveyor is also arranged in the principal plane of the printed product to be gripped, and also the transfer by the transferring conveyor is effected substantially within this plane. By substantially maintaining the principal plane of the printed product, as it is generally defined by its spatial orientation at the discharge end of the feeder, also for the transfer cycle of the printed product towards the collecting conveyor, the technical efforts to achieve the required function can additionally be reduced.

These objects and other objects and features of the present invention will become more apparent through the following description that will be carried out by reference to the appended drawings, by the content of the drawings and by the elements mentioned in the subclaims.

5. BRIEF DESCRIPTION OF THE DRAWINGS

FIG. 1 is a perspective view of the apparatus according to a preferred embodiment of the present invention, showing a vacuum element pulling down a leading edge of a foremost signature to create a space between the leading and the next upstream signatures. The upstream separating gripper will soon grip the reference corner of the leading portion of the foremost signature. The downstream separating gripper has already gripped a printed product and pulls it away from the feeder.

FIG. 2 is a perspective view of the apparatus according to a preferred embodiment of the present invention, showing the upstream separating gripper with a separating wedge running across a space created between the foremost signature and the next upstream one. The downstream separating gripper has fully extracted a printed product from an incoming shingled stream and transferred it towards the buffer shelf.

6. DETAILED DESCRIPTION OF THE INVENTION

A preferred embodiment of the method, apparatus and device for feeding flat printed products according to the present invention will now be described in detail referring to the appended drawings.

Figure 1:
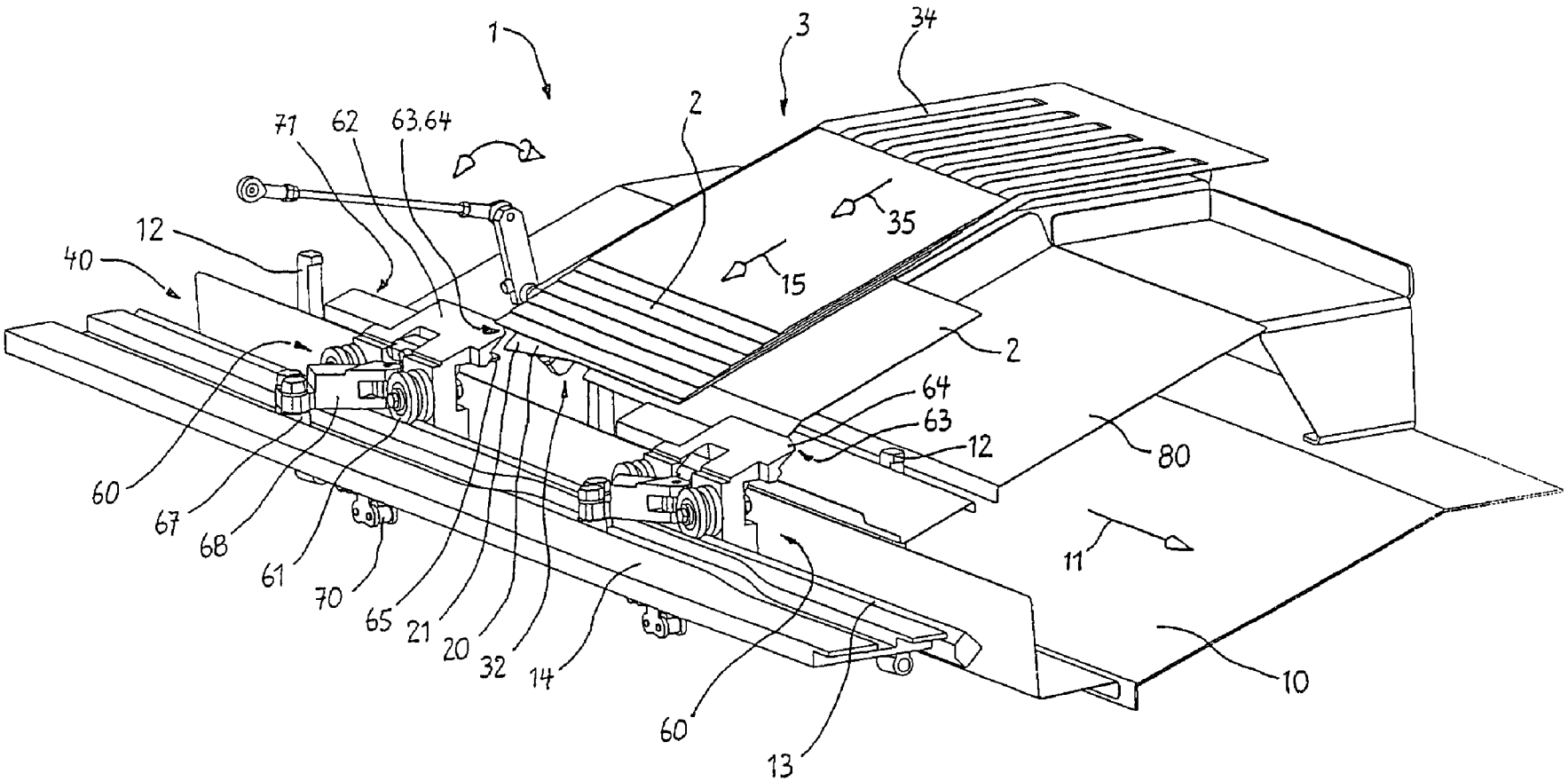

Referring to FIG. 1, there is provided only one feeder generally identified by numeral 1 with feeding elements, which is designed to feed incoming signatures 2 to a collecting conveyor 10 forming vertical piles 4 of different signatures being forwarded to a downstream bindery equipment such as a binding station or an adhesive binder (not shown), where the piles 4 of printed products collected by the collecting conveyor 10 are pasted together to form a book or a brochure.

The feeder 1 may comprise any kind of feeding elements, for example driven belt conveyors and the like. Any kind of equipment which advances the printed products towards the discharge end of the feeder 1 is suitable. Also a hopper is meant to be a feeding element, as it advances printed products through a pile towards the discharge end of the hopper, and, depending upon the location where it is arranged, also the discharge end of the feeder 1. The printed products or signatures 2 are supplied in a substantially flat lying way. Each feeder 1 feeds a collection of identical printed products. From each collection of identical printed products exactly one single specimen must be selected and gathered in a correct sequence in a pocket of the collecting conveyor 10 as a pile 4, so that a book can be completed in the downstream bindery equipment. So very often a gathering system using the claimed invention comprises more feeders 1 than just the one feeder 1 shown in FIG. 1. However, the function of the invention can well be described also by just one feeder 1.

The apparatus as shown in FIG. 1 comprises at least one feed conveyor station 3, each station 3 feeding one of the printed products or signatures 2 being successively collated to form piles 4 in successive pockets of the collecting conveyor 10. The pockets are separated by pushing rods 12. Obviously, a plurality of such feed conveyor stations 3 placed in parallel transversally to the first direction 11 of the collecting conveyor 10 are usually required to individually deliver each one of the different signatures 2 to be assembled together to form the book or similar product.

As it can clearly be seen from FIG. 1, the first direction 11, in which the collecting conveyor 10 moves the piles 4, clearly deviates from the second direction 15, in which the feeder 1 advances the printed products. In the embodiment shown in FIG. 1, the second direction 15 in fact is crosswise and rectangular towards the first direction 11. However, the angle between the first direction 11 and the second direction 15 does not have to be exactly 90°, minor deviations from this angle are also possible according to the invention.

Feeder 1 and the feed conveyor station 3 comprise a motorised belt 34 for supporting and advancing the stream of signatures 2 in direction 35 equal to direction 15, which stream have a shingled formation in the shown example, and which are backwardly superimposed in direction 35 in the shown example. Of course, the signatures 2 may also be advanced spaced apart from each other by the feeder 3, or partially shingled and partially separated, in a continuous product flow or in an interrupted or intermitted way. As in general the printed products are quite continuously fed during a working period, the product flow is generally regarded as being continuous, even is smaller deviations in the continuity might occur. The inclination angle in direction 35 may also be altered as required or suitable. The general structure of such feeders 3 is well known by individuals of ordinary skill in the field, and the respective method of feeding the signatures 2 may be selected as required by the respective application and as it seems to be suitable.

The system further comprises a transferring conveyor 40 with a least one separating gripper 60. In FIG. 1, a plurality of separating grippers 60 are assembled to a driving chain, from which only one chain link 70 for each separating gripper 60 is shown in the drawing for simplification purposes. The movement direction of the driving chain is synchronized with the first movement direction 11 of the collecting conveyor 10, so that both, the separating grippers 60 and the collecting conveyor 10, travel along a at least substantially linear path and at least substantially in parallel to the orientation of the other respective element.

If more than one separating gripper 60 is employed in an apparatus, it is advantageous if they are arranged in regular distances to a driving element like the chain 70. The distance may be equal to the distance between feeders 1, but if it is smaller than the distance between the discharge ends of the feeders 1, it is easier to add the gripped signatures to the piles 4 accumulated in the collecting conveyor 10.

In addition to the alignment of the movement direction of the separating grippers 60 and the collecting conveyor 10, also the movement speed of the separating grippers 60 and the pushing rods 12 of the collecting conveyor 10 is at least about the same, preferably identical. To ensure its mobility, separating-gripper device 60 further comprises three pulleys 61 to travel on upper and lower edges of guiding rail 13. The separating grippers 60 are driven over a linear path in the first direction 11 through a chain connected to chain link 70.

Figure 2:
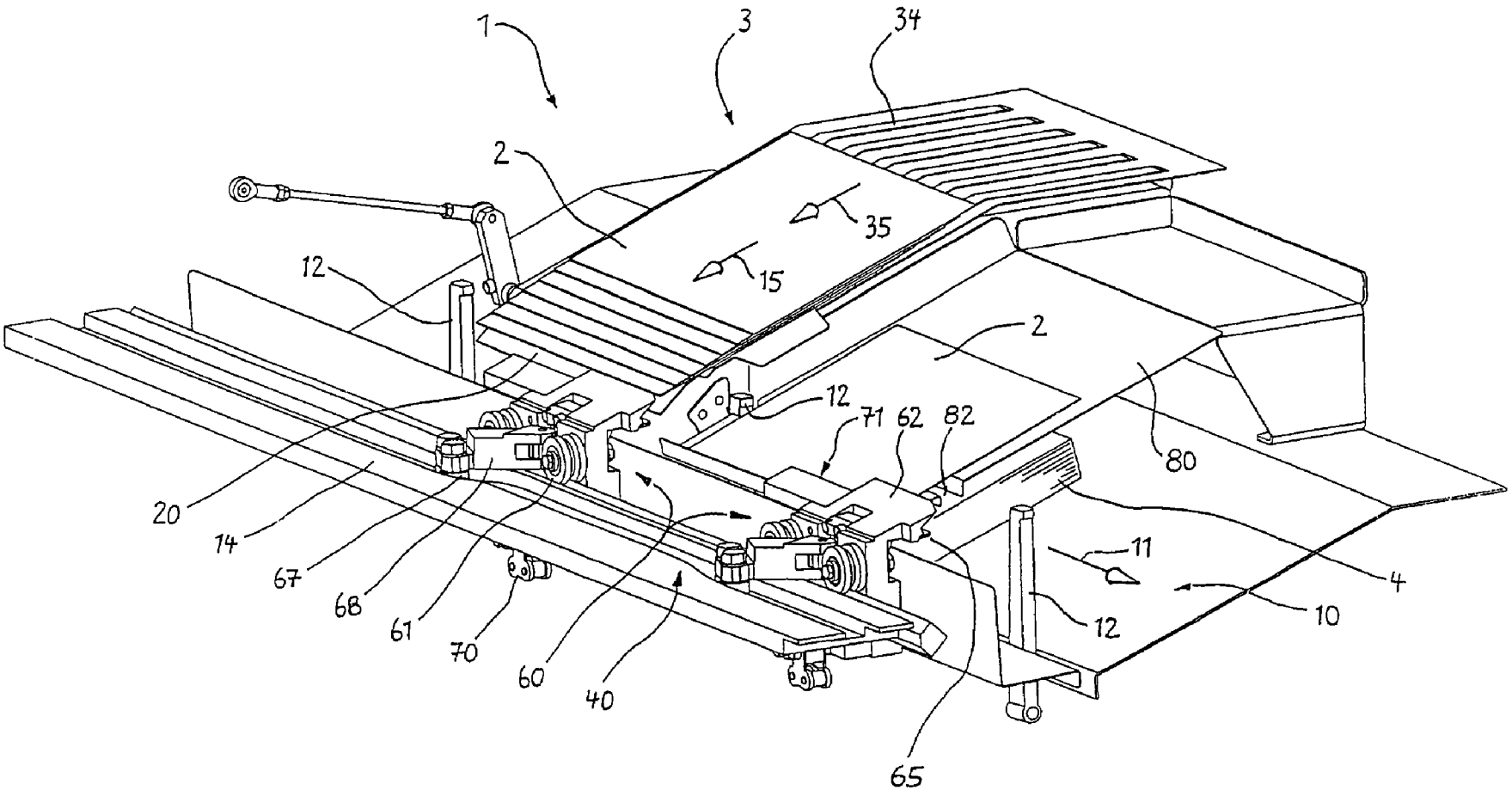

In FIG. 2, the two separating grippers 60 are shown in a slightly advanced position. The downstream separating gripper 60 has already opened the jaw members 62, 65 and thereby released the signature 2. The signature 2 has fallen down upon the buffer shelf 80. The buffer shelf 80 provides a slit 82, through which the upper ends of pushing rods 12 are extending, when they are moved along the first direction 11. It can be seen from FIG. 2, that the next pushing rod 12 already approaches the buffer shelf 80. The buffer shelf 80 may comprise a blunt surface, which slows down and stops the movement of the signature 2 released by a separating gripper 60 and which especially supports the signature 2 to slide out of engagement with the jaw members 62, 65 of the separating gripper 60. The pile 4, which comprises of signatures already collected by pushing rod 12 from upstream feeders 1, is fed through the hollow space underneath the buffer shelf 80. The printed products accumulated already in the pile 4 are also supplied in a substantially flat lying way. The printed products in the feeder 1 and those accumulated in a pocket of the collecting conveyor 10 may advantageously be supplied in a substantially horizontal or substantially vertical plane, as it deems to be suitable in an application. If the pushing rod 12 advances further from the shown position, it will push the signature 2 into the first direction 11 of the collecting conveyor 10, and thereby the signature 2 will slide down from the buffer shelf 80 and rest on top of pile 4. Accordingly, before the pile 4 reaches the next feed conveyor station 3, the signature 2 will have been collected by the collecting conveyor 10 on top of the pile 4.

The upstream separating gripper 60 has moved along a straight line in the first direction 11 from the edge 21 of the leading portion 20 of a foremost signature 2 as shown in FIG. 1 nearly towards the opposite edge of the signature 2. Along this movement, the separating wedge 63 has supported the neighbouring upstream printed product and at the same time bent down and separated the leading portion of the lower signature 2, so that the gripping of the leading portion 20 of the lower printed product is eased. The upstream separating gripper 60 is still shown in an open position, but upon a continuation of its movement it will immediately close and grip the respective signature 2.

Figure 3:
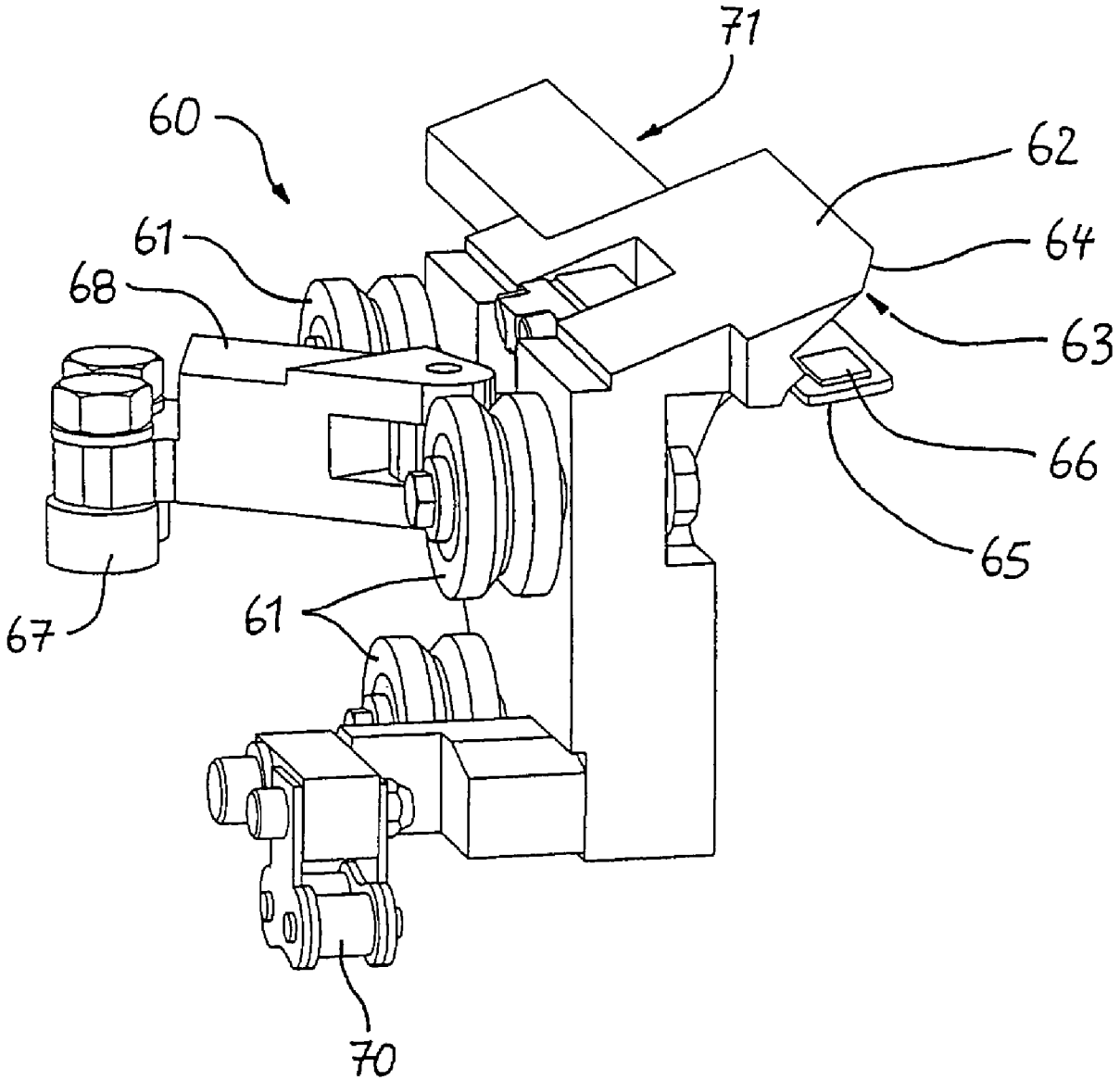
FIG. 3 is a perspective view of the separating gripper according to a preferred embodiment of the present invention to better show details of the separating gripper device in an open position.

In FIG. 1 and especially also in FIG. 3, more details of the separating grippers 60 are shown. The two shown separating grippers 60, one upstream, one downstream of the first direction 11, each comprise a top jaw member 62 terminated on its downstream end by a separating wedge portion 63 comprising a sharp separating edge 64. The upstream separating gripper 60 is shown in an open status, whereas the downstream separating gripper 60 is shown with closed jaw members 62, 65. In the shown example, the top jaw member 62 is fixed, and the lower jaw member 65 is movably driven. However, apart from the shown example, also only the top jaw member 62 or both, the top jaw member 62 and the lower jaw member 65 may be movably driven.

To bring an increased clamping force upon a signature 2 gripped by a separating gripper 60, so that it is gripped more safely, the top jaw member 62 and/or the lower jaw member 65 may partially or completely be made from a flexible material. The clamping force is also advanced, if it not effected by the complete surface of a jaw member 62, 65, but rather concentrated upon a few clamping spots. In the shown example, an actuated lower jaw member 65 comprises a friction pad 66 which cooperates with fixed top jaw member 62 to provide an individually controllable separating gripper 60 to grip flat printed products. As the friction pad 66 protrudes from the other surface of the lower jaw member 65 and concentrates the clamping force in a closed position of the lower jaw member 65 upon its surface, the friction pad 66 defines a clamping spot. A clamping spot could also be generated by other protrusions on the surface of either the top jaw member 62 or the lower jaw member 65 or both. To spread the clamping force over a bigger area of the gripped signature, it is advantageous to arrange the clamping spots spaced apart from each other.

Closing of the separating grippers 60 is accomplished by laterally pushing on roller 67 of rocker 68 causing connecting rod 69 to be pulled and in turn pivoting lower jaw member 65 upwards. The separating gripper assembly returns to its normal open position by back pushing on roller 67 of rocker 68. Individually controlled actuation of the separating grippers 60 is accomplished through the double cam 14 extending at least substantially parallel and close to guiding rail 13, and being periodically hit by roller 67 when separating grippers 60 are moving on rail 13. The double cam 14 provides a sectional linear orientation, but in those section where the separating grippers 60 shall be closed and opened, the double cam 14 shows a curved and protruding shape.

Each separating gripper 60 comprises a supporting surface 71, which supports the safe grip of a signature 2 in the jaw members 62, 65. The supporting surface 71 touches the leading portion 20 of a signature during the movement of the separating gripper 60 along the first direction 11 and thereby slightly aligns the signature as long as the jaw members 62, 65 are not yet closed.

As it can be seen in FIG. 1, the downstream separating gripper 60 has already gripped a foremost signature 2 from the shingled formation in the feeder 1 and partially transferred it along the first direction 11 towards the buffer shelf 80. The signature 2 gripped by the shown downstream separating gripper 60 is transferred in a spatial orientation, which is substantially identical to the spatial orientation it has had, when it was gripped by the downstream separating gripper 60. So during the transfer phase of the signature 2 from the feed conveyor station 3 towards a pocket of the collecting conveyor 10, the signature 2 substantially maintains it spatial orientation. This result can be achieved, because the transfer path of the transferring conveyor 40 is arranged in the same principal plane the signature 2 or printed product has, when it is gripped at the discharge end of feeder 1.

Figure 4:
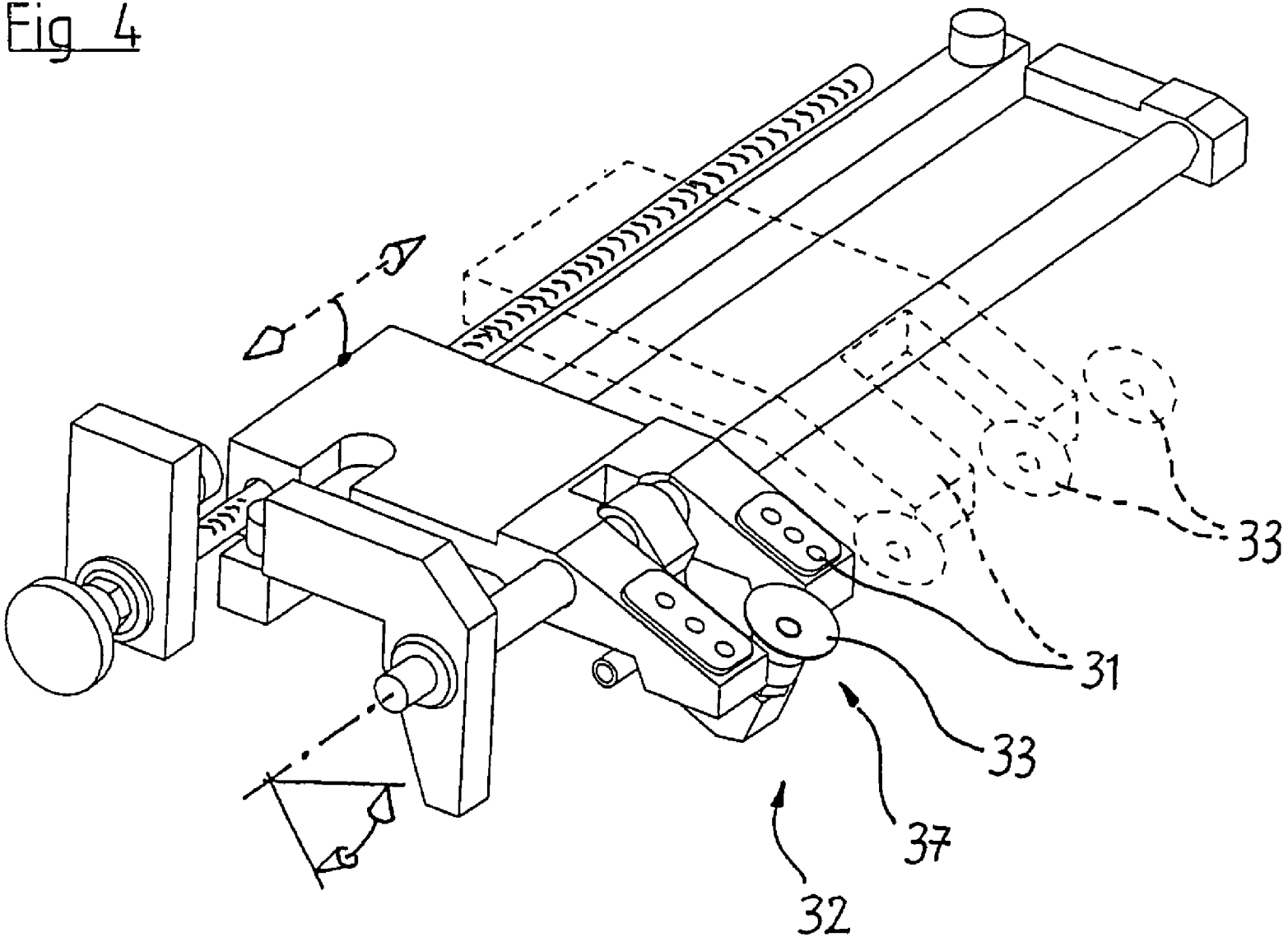
FIG. 4 is a perspective view of an adjustable vacuum pull-down and retaining assembly mounted on a retaining plate at the outlet of a feeder.

Feeder 1 and the feed conveyor station 3 are further provided with special tooling at the downstream discharge end thereof, which is shown in more detail in FIG. 4. Said tooling is a selecting device that comprises an actuated vacuum element 33 like a suction cup, which is able to effect a sucking force. In FIG. 4, there is shown one vacuum element 33 in full lines, and additional vacuum element 33 in dotted lines to indicate, that there may be employed more than just one vacuum element 33. The vacuum element 33 is fixed on a pick-up arm 32. In addition to the suction cups, there may also be arranged one or more perforated vacuum retaining plates 31, which may extend across the width of feed conveyor station 3 and in parallel to the first direction 11. Vacuum retaining plates 31 offer openings 37 to enable vacuum cups 33 to contact the underside of the leading edge 20 of the foremost signature when in their uppermost position. The pick-up arm 32 is pivotable, as it is indicated by respective arrows in FIGS. 1 and 4. The pick-up arm 32 may also be designed to be laterally adjustable, so that it can be easily adapted towards different measures of signatures 2.

In operation, the system functions as follows, according to a preferred method of the present invention: feeder 1 advances signatures 2 in direction 15,35 until the leading portion 20 of the foremost signature exceeds the downstream end of conveyor belt 34 to lie above vacuum retaining plate 31. Then the vacuum pick-up arm 32 is actuated to bring suction cups 33 in contact with the lower surface of said leading portion 20 of the signature, apply vacuum momentarily at suction cups 33, for example through a synchronized rotary valve, and bend and pull the signature down in contact with permanently activated vacuum retaining plate 31, so that at least an upstream edge 21 of said leading portion is separated from upstream signatures 2. It might already be sufficient, if only one vacuum element is positioned in a way, that it is operable to bend down only the upstream edge 21 of a leading portion 20 of a signature 2, creating a space, as it is shown in FIG. 1. But of course, there may be more vacuum elements 33. Through appropriate timing of the apparatus, one of the traveling separating grippers 60 is at that moment approaching edge 21 and sharp edge 64 of separating wedge portion 63 gradually enters said space or gap and gradually increases spacing while supporting upper signatures with potential help of actuated retaining needles or the like as the gripper 60 progresses between the signatures in its open position, as already explained above in connection with FIG. 2. Once approaching the downstream edge 20 of said signature leading portion, roller 67 runs up a higher portion of linear cam 14 which causes closing of separating-gripper device 60 and gripping of the corner of the leading edge of the foremost signature 2, as shown in FIG. 1 for the downstream separating gripper 60. This separating gripper 60 pursues its travel along its linear path in first direction 11 until the signature 2 fully clears signature stream 2—upper signatures 2 may be prevented from sliding in the pulling direction through an appropriate stop device 91. Finally, once the signature 2 is completely extracted from the stream 2, roller 67 runs down onto a lower portion of cam 14 causing gripper 60 to open and release the signature 2 on a buffer shelf 80 above a pocket of collecting conveyor 10, just before the signature 2 is dropped on top of the signature pile 4 in the pocket and carried by push rod 12 to be forwarded to a downstream bindery equipment such as a binder applying glue to the edge of the stack of signatures to form an assembled product, such as a book.

Apart from the description above, a vacuum element 33 may also be used to bend an uppermost or lowermost signature 2, depending from the design of the whole apparatus and the feeders 1.

Providing a plurality of feeders 1 equipped as described above and as many separating grippers 60 travelling transversally to stream direction 15,35, a complete system is provided whereby a plurality of different signatures can be handled and successively dropped in a pocket to form a stack according to the printed product to be assembled.

Figure 5:
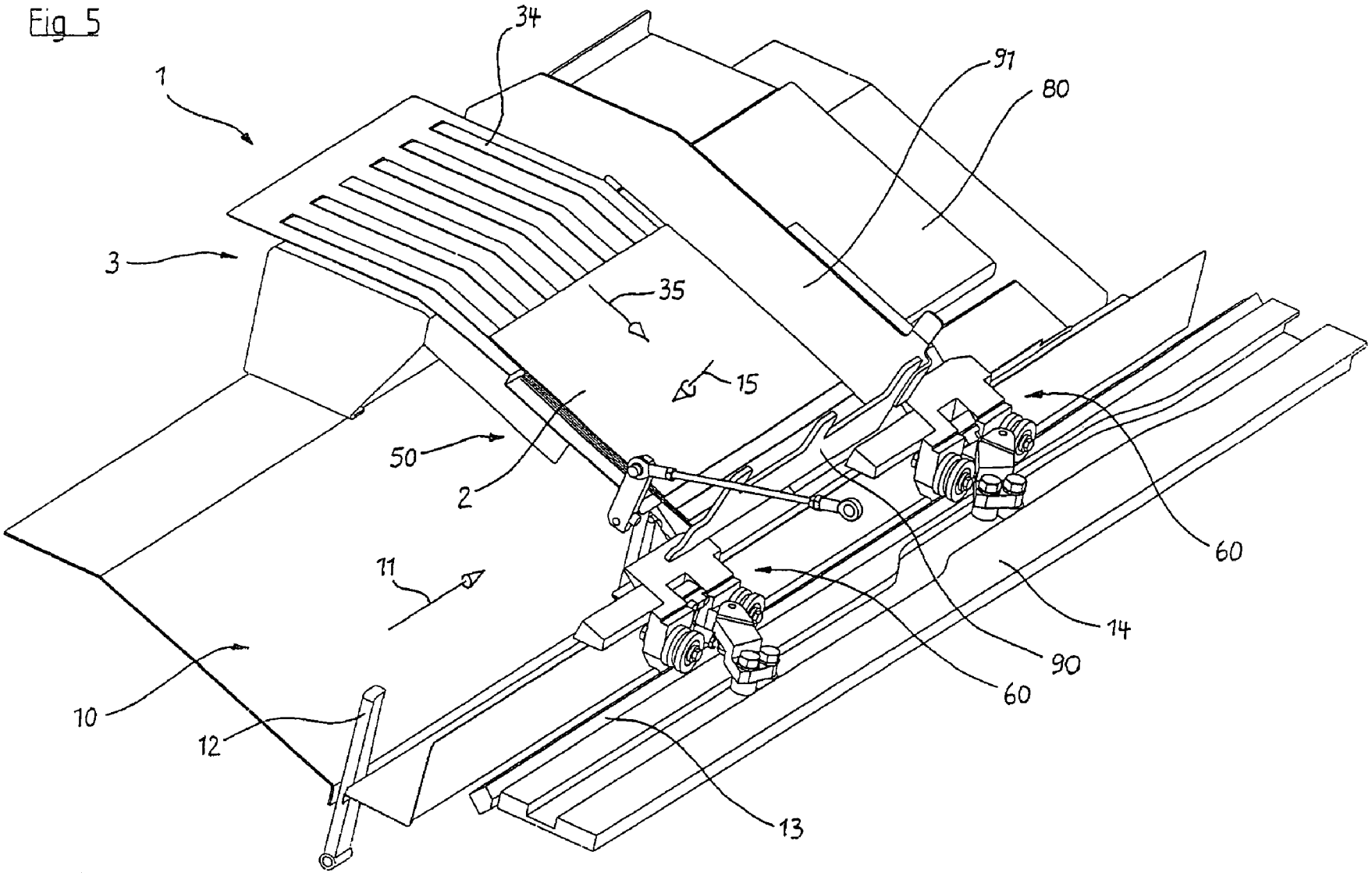
FIG. 5 is a perspective view of the apparatus according to a preferred embodiment of the present invention, showing a hopper at the discharge end of a feeder, where the lowermost of the printed products accumulated in the hopper is gripped by the separating gripper and transferred towards the collecting conveyor.

In FIG. 5 an apparatus is shown using a hopper 50. The signatures 2 are fed by the feeder 1 into the hopper 50, which is arranged as a feeding element of feeder 1. Of course, the signatures 2 can also be loaded into the hopper by hand. As the hopper 50 is arranged at the discharge end of the feeder 1, the signatures 2 accumulated therein on a pile need to be gripped by the separating grippers 60 directly. To achieve this, it is useful to grip one of the lowermost signatures 2 from the pile of signatures 2, preferably the lowermost. By feeding the signatures 2 from above into the hopper 50 and by pulling out the lowermost signatures from the bottom, the signatures 2 are moving in a downward direction through the hopper 50. This downward direction deviates from the first direction, and it can also be regarded as a second direction as described above. To improve the aligned orientation of the signatures within the hopper 50, the hopper may be inclined towards the vertical direction. The hopper 50 may also comprise a backgauge 90, against which the signatures 2 may rest in alignment.

It should be noted that the system of the present invention described above by means of a preferred embodiment thereof, advantageously provides direct transfer of any flat article fed in shingled or not-shingled stream to a collecting conveyor, with or without transiting through a hopper and without critical make-ready operation. The apparatus also provides a combined separating gripper for printed products travelling generally linearly in the direction of the collecting conveyor, especially transversally to the stream direction, and enables fast action over very short distances and with minimal handling of the article. Therefore, very high speeds can be achieved by the feed system with high yield, using very simple, reliable and low cost and low maintenance equipment.

Therefore, one can contemplate that the method and apparatus of the present invention avoid costly interruptions of the bindery line due to miss-feeds usually occurring at a vacuum belt bed conveyor signature feeder known from prior art because of an excessive steady or momentary load in hoppers, or because of distortions usually created on the top lower sheets of signatures by the mechanical processing.

Although the present invention has been described by means of preferred embodiments thereof, it is contemplated that various modifications may be made thereto without departing from the spirit and scope of the present invention. Accordingly, it is intended that the embodiments described be considered only as illustrative of the present invention and that the scope thereof should not be limited thereto but be determined by reference to the claims hereinafter provided and their equivalents.

Although the present invention is described by reference to the handling of signatures in a bindery process, it shall be deemed applicable in a variety of applications dealing with flat products in sheet form.

What is claimed is:

1. Method for gathering flat printed products, especially signatures (2), by selecting a single printed product from each of a multitude of collections of identical printed products and conveying the selected printed products towards a collecting conveyor (10), where the selected printed products are piled up, which collecting conveyor moves along a generally straight line in a first direction (11), whereby the method comprises the following steps:

advancing the printed products in a second direction (15) crosswise to said first direction in a continuous flow of printed products with a feeder (1) with feeding elements upstream of the collecting conveyor (10), gripping a leading portion (20) of a printed product at the discharge end of said feeder (1) by separating grippers (60) of a transferring conveyor (40) which is arranged adjacent to and travels parallel to the collecting conveyor (10), moving the gripped printed product with the transferring conveyor (40) away from the feeder substantially along a path extending generally along said first direction (11) of the collecting conveyor (10).

2. Method according to claim 1 wherein the feeding element is a hopper (50).

3. Method according to claim 1 wherein a transfer path of the transferring conveyor (40) is arranged in a principal plane of the printed product to be gripped at the discharge end of said feeder (1).

4. Method according to claim 1 characterized in, that the printed products delivered by the feeder (1) are advanced forward in a shingled formation.

5. Method according to claim 4 characterized in, that the shingled printed products are arranged on the feeder (1) backwardly superimposed.

6. Method according to claim 1 characterized in, that the printed products in the feeder (1) and/or the piles (4) in the collecting conveyor (10) are supplied in a substantially horizontal or substantially vertical plane.

7. Method according to claim 1, characterized in, that the printed products delivered by the feeder (1) are piled in a hopper (50) and the printed product to be taken by the transferring conveyor (40) is one of the lowermost piled samples of the printed products.

8. Method according to claim 1, characterized in, that the printed products are signatures (2) and the leading portion (20) of the signature (2) to be gripped by the transferring conveyor (40) is the backbone of the signature (2).

9. Method according to claim 1 characterized in, that a sucking force is applied by at least one vacuum element (33) upon at least the leading portion (20) of a foremost, uppermost or lowermost printed product so that such portion (20) is bent away thereby from the neighbouring upstream printed product.

10. Method according to claim 9 characterized in, that the sucking force acts upon an edge (21) of the leading portion (20) of the printed product upstream of the transferring conveyor (40), and that the leading portion (20) of the printed product is bent away by a separating device, which is moved along a straight line in the first direction from the edge (21) towards the opposite edge of the printed product, and which supports neighbouring upstream printed products during this movement, so that the gripping of the leading portion (20) of the printed product is eased.

11. Apparatus for gathering flat printed products, especially signatures (2), comprising:

a plurality of feeders (1) arranged in a sequence each for a collection of identical printed products with a selecting device for selecting single flat printed products;

a collecting conveyor (10), where the selected printed products are piled up, which collecting conveyor (10) moves along a generally straight line in a first direction (11);

wherein the feeders (1) advance the printed products by feeding elements in a second direction (15) crosswise to said first direction in a continuous flow of printed products;

a transferring conveyor (40) comprising at least one separating gripper (60), which is adapted to grip a leading portion (20) of a printed product at a discharge end of the feeders (1), respectively, wherein the transferring conveyor (40) is arranged adjacent to and travels parallel to the collecting conveyor;

wherein the transferring conveyor (40) moves the printed flat products away from the feeder substantially along a path extending generally along said first direction (11) of the collecting conveyor (10).

12. Apparatus according to claim 11 characterized in, that the feeding elements comprise a hopper (50) where the second direction (15) is the movement of the printed products in a pile through the hopper (50).

13. Apparatus according to claim 11 characterized in, that the feeders (1) are designed to advance the printed products in a shingled formation.

14. Apparatus according to claim 11 characterized in, that the printed products in the feeder (1) and/or the piles (4) in the collecting conveyor (10) are supplied in a substantially flat lying way.

15. Apparatus according to claim 11 wherein a transfer path of the transferring conveyor (40) is arranged in a principal plane of the foremost printed product at the discharge end of its feeder (1).

16. Apparatus according to claim 11 characterized in, that the separating gripper (60) comprises a separating wedge portion (63) with a separating edge (64), which is facing towards the travelling direction of movement of the separating gripper (60).

17. Apparatus according to claim 11 comprising at least one vacuum element (33) for applying a sucking force to at least the leading portion (20) of a foremost, uppermost or lowermost printed product and which is arranged in a position that it bends away such portion (20) of the printed product thereby from the neighbouring upstream printed product.

18. Apparatus according to claim 17 wherein the at least one vacuum element (33) is arranged at a position that it acts upon an edge (21) of the leading portion (20) of the printed product upstream of the transferring conveyor (40).

19. Apparatus according to claim 11 characterized in, that the printed products are fed into an inclined hopper (50), so that the printed products are resting aligned with their backbones along a back-gauge (90).

20. Apparatus according to claim 11 characterized in, that a plurality of separating grippers (60) are assembled in regular distances to a driving element, which is movable along the discharge ends of the feeders (1) at the same speed and in the same direction as the collecting conveyor (10), and that the separating grippers (60) travel on a guiding rail (13).

21. Apparatus according to claim 11, characterized in, that the distance between the separating grippers (60) is smaller than the distance between the discharge ends of the feeders (1).

22. Apparatus according to claim 11, characterized in, that the separating gripper (60) comprises a fixed top jaw member (62) with a separating wedge portion (63) with a separating edge (64) and a pivotable lower jaw member (65).

23. Apparatus according to claim 22 wherein the fixed top jaw member (62) and/or the pivotable lower jaw member (65) is made from a flexible material to be able to build up a clamping force.

24. Apparatus according to claim 22 wherein the pivotable lower jaw member is driven by a roller (67) on a lever acting upon a connecting rod, and that the roller (67) travels along a cam (14).

25. Apparatus according to claim 22 wherein the fixed top jaw member (62) and/or the pivotable lower jaw member (65) comprise a plurality of clamping spots which are spaced apart from each other.

26. Apparatus according to claim 11 characterized in, that the separating gripper (60) comprises a supporting surface (71) by which the printed product may be supported after being gripped.

27. Apparatus according to claim 11 characterized in, that each discharge end of a feeder (1) is associated with a buffer shelf (80), on which the gripped printed products can be dropped by the separating grippers (60) and from where they can be forwarded by the collecting conveyor (10).

* * * * *